US011660639B2

(12) United States Patent
Winter et al.

(10) Patent No.: US 11,660,639 B2
(45) Date of Patent: May 30, 2023

(54) METHOD AND INSTALLATION FOR MANUFACTURING A STARTING MATERIAL FOR PRODUCING RARE EARTH MAGNETS

(71) Applicant: NETZSCH Trockenmahltechnik GmbH, Selb (DE)

(72) Inventors: Frank Winter, Mühlheim (DE); Hermann Sickel, Gambach/Muenzenberg (DE); Wilhelm Femengel, Kleinostheim (DE)

(73) Assignee: NETZSCH Trockenmahltechnik GmbH, Selb (DE)

( * ) Notice: Subject to any disclaimer, the term of this patent is extended or adjusted under 35 U.S.C. 154(b) by 832 days.

(21) Appl. No.: 16/035,154

(22) Filed: Jul. 13, 2018

(65) Prior Publication Data

US 2019/0027284 A1 Jan. 24, 2019

(30) Foreign Application Priority Data

Jul. 19, 2017 (DE) ..... 102017116272.0

(51) Int. Cl.
*B22F 1/052* (2022.01)
*B07B 13/00* (2006.01)
(Continued)

(52) U.S. Cl.
CPC ..... *B22F 1/052* (2022.01); *B07B 13/003* (2013.01); *B07B 13/04* (2013.01); *B22F 3/12* (2013.01);
(Continued)

(58) Field of Classification Search
CPC ..... B07B 13/003; B07B 13/04; B22F 1/0014
See application file for complete search history.

(56) References Cited

U.S. PATENT DOCUMENTS 5,462,234 A * 10/1995 Patzelt ..... B02C 23/14 241/19
5,976,224 A * 11/1999 Durant ..... B01D 45/00 110/165 A
2002/0129874 A1 9/2002 Kaneko et al.

FOREIGN PATENT DOCUMENTS

CN 104550023 A 4/2015
EP 0414376 A2 2/1991
(Continued)

OTHER PUBLICATIONS

European Search Report Application No. EP 18 182 618 Completed: Nov. 16, 2018; dated Nov. 27, 2018 11 pages.

*Primary Examiner* — Anthony J Zimmer
*Assistant Examiner* — Sean P. O'Keefe
(74) *Attorney, Agent, or Firm* — Whitmyer IP Group LLC

(57) ABSTRACT

A method for producing a powdered starting material, which is provided for production of rare earth magnets, including includes the following steps: pulverizing an alloy, including at least one rare earth metal, wherein a powdered intermediate product is formed from the alloy including the at least one rare earth metal, and carrying out at least one classification aimed at particle size and/or particle density for the powdered intermediate product. A fraction of the powdered intermediate product, which is formed by the at least one classification, is used for fabrication of rare earth magnets. Furthermore, at least one dynamic classifier is provided, implementing at least one classification directed at particle size and/or particle density for the powdered intermediate product and thereby separates the fraction from the powdered intermediate product, which forms the starting material for manufacturing rare earth magnets.

11 Claims, 4 Drawing Sheets

(51) Int. Cl.

| | |
|---|---|
| ***B22F 9/04*** | (2006.01) |
| ***B07B 13/04*** | (2006.01) |
| ***H01F 41/02*** | (2006.01) |
| ***B22F 3/12*** | (2006.01) |
| ***H01F 1/057*** | (2006.01) |
| ***B22F 3/24*** | (2006.01) |
| ***C22C 28/00*** | (2006.01) |
| ***H01F 1/053*** | (2006.01) |
| ***C22C 1/05*** | (2023.01) |
| *C22C 33/02* | (2006.01) |
| *B02C 15/00* | (2006.01) |
| *B04C 5/00* | (2006.01) |

(52) U.S. Cl.

CPC ..... *B22F 3/24* (2013.01); *B22F 9/04* (2013.01); *C22C 1/058* (2013.01); *C22C 28/00* (2013.01); *H01F 1/0536* (2013.01); *H01F 1/0577* (2013.01); *H01F 41/0246* (2013.01); *H01F 41/0253* (2013.01); *B02C 2015/002* (2013.01); *B04C 5/00* (2013.01); *B22F 2009/044* (2013.01); *B22F 2999/00* (2013.01); *C22C 33/025* (2013.01); *C22C 2202/02* (2013.01); *H01F 41/0266* (2013.01)

(56) References Cited

FOREIGN PATENT DOCUMENTS

| | | | |
|---|---|---|---|
| EP | 2273513 | A1 | 1/2011 |
| EP | 2599555 | A1 | 6/2013 |
| JP | 2000317338 | A | 11/2000 |
| WO | 2007045320 | A1 | 4/2007 |
| WO | 2010017865 | A2 | 2/2010 |

* cited by examiner

METHOD AND INSTALLATION FOR MANUFACTURING A STARTING MATERIAL FOR PRODUCING RARE EARTH MAGNETS

CROSS-REFERENCE TO RELATED APPLICATIONS

This application claims priority from German Patent Application No. 10 2017 116 272.0, filed on Jul. 19, 2017. The entire content of that priority application is fully incorporated by reference herewith.

TECHNICAL FIELD

The present invention relates to a method for manufacturing a starting material for the manufacture of rare earth magnets, a starting material and an installation for producing a starting material for producing rare earth magnets.

BACKGROUND

A permanent magnet is an item made of a magnetizable material, for example, iron, cobalt or nickel, which retains its static magnetic field without requiring an electrical current flow (in contrast with electromagnets). A permanent magnet can be created by applying a magnetic field to a ferromagnetic material.

The term "rare earth magnet" is understood to refer to a group of permanent magnets that consist essentially of ferrous metals (iron, cobalt or, less often, nickel) and rare earth metals (in particular neodymium, samarium, praseodymium, dysprosium, terbium, gadolinium). They are characterized in that they have a high magnetic remanence flux density and, at the same time, a high magnetic coercitive field strength and therefore they have a high magnetic energy density.

An alloy of neodymium, iron and boron (NdFeB) makes it possible to produce very strong magnets at a relatively low cost, for example. They are produced by means of powder metallurgical methods, but today they are also produced as plastic-bonded magnets. For a long time, the use temperatures of these magnets were limited to 60-120° C., but in some recent developments with additional additives of other rare earth elements, in particular dysprosium or terbium, the thermal stability can be increased to more than 200° C. To increase the corrosion stability, other alloy constituents, such as cobalt, are often added to the alloy.

Permanent magnets are produced from crystalline powder. The magnetic powder is pressed into a mold in the presence of a strong magnetic field. In doing so, the crystals become aligned with their preferred magnetization axis being aligned in the direction of the magnetic field. The pellets are then sintered. In sintering, the pulverized constituents of the powder are bonded together by heating or compacted, but none of the starting materials, or at least not all of them, are melted. In doing so, the pellets are heated—often under an elevated pressure—so that the temperatures remain below the melting point of the main components, so that the shape (mold) of the material is retained.

With a sintering temperature above 1000° C., the magnetization which is active only outwardly is lost because the thermal motion of the atoms leads to largely antiparallel alignment of the elementary magnets in the crystals. However, since the orientation of the grains in the sintered composite are not lost, the parallel alignment of the elementary streams can be restored by a sufficiently strong magnetization pulse after cooling the magnets.

The magnetic powder is produced in particular by milling the corresponding alloys and/or constituents, for example, in fluidized-bed jet mills or similar milling installations. In fluidized-bed jet mills, a defined superfine milling takes place there in particular, namely with a precise upper grain limit, but with a not-insignificant fraction of superfine particles. The pulverization energy here is supplied by gas jets.

In practice it has been found that magnetic powders that can be produced by means of the methods known from the state of the art are highly reactive chemically and will react with oxygen or nitrogen from the environment for this reason even at a low oxygen concentration. Therefore, powder fires may be associated with further processing of the magnetic powder. Practice has also shown that it is often very difficult to obtain an orientation with magnets produced by using magnetic powders known from the state of the art, so that the remanence of the magnets produced from the magnetic powders that are already known today is exacerbated. Such disadvantages may be associated in particular with a high volume percentage of fines in the magnetic powder.

In addition, it may happen that an opposing field stability and/or coercitive field strength, such that the other improvement can be achieved with magnets produced from the magnetic powders already known in the state of the art because of the high volume percentage of coarse particles they contain.

SUMMARY

The object of the invention is to be able to further optimize the manufacture of the starting mixture for production of rare earth magnets and to thereby be able to produce improved rare earth magnets.

The object defined above is achieved by the subject matters having the features in the independent claims. Additional advantageous embodiments are described in the dependent claims.

The invention relates to a method for producing a powdered starting material and for manufacturing rare earth magnets.

A first step in the method involves pulverizing an alloy comprising at least one rare earth metal, wherein a powdered intermediate product is obtained from the one alloy comprising at least one rare earth metal.

Another step involves carrying out at least one classification directed at the particle size and/or density for the powdered intermediate product, wherein a fraction of the powdered intermediate product formed by means of the at least one classification then forms the starting material provided for manufacturing rare earth magnets.

For this method, at least one dynamic classifier is provided, at least one dynamic classifier implementing at least one classification aimed at particle size and/or density for the powdered intermediate product and thereby separating the fraction from the powdered intermediate product, which forms the starting material provided for manufacturing rare earth magnets.

In a preferred embodiment, it is possible to provide that the powdered intermediate product is sent to at least one static classifier. Following this step, a fraction separated from the powdered intermediate product by means of at least one static classifier can be sent to at least one dynamic classifier, which implements the at least one classification aimed at particle size and/or density for the fraction separated from the powdered intermediate product by means of the at least one static classifier and thereby separating the fraction from the portion which forms the starting material that is provided for manufacturing rare earth magnets.

It is also possible that the at least one dynamic classifier classifies and also disperses the powdered intermediate product, as a result of which the fraction, which forms the starting material provided for manufacturing rare earth magnets, is separated from the powdered intermediate product.

In addition, it is conceivable that coarse material is separated from the powdered intermediate product as part of a first classification of the at least one dynamic classifier, aimed at particle size and/or density, separates the coarse material from the powdered intermediate product, and as part of a second classification aimed at particle size and/or density, the at least one dynamic classifier separates fines from the powdered intermediate product. A fraction of the powdered intermediate product thereby separated from the fines and the coarse material may supply the fraction, which forms the starting material provided for manufacturing rare earth magnets.

Some embodiments that have proven successful are those in which the first classification aimed at particle size and/or density and the second classification aimed at particle size and/or density are carried out by means of exactly one dynamic classifier. In addition, the alloy comprising at least one rare earth metal can be pulverized, preferably mechanically, in two separate classifying steps, wherein the powdered intermediate product is formed in separate steps from the pulverized material.

It is possible that the at least one dynamic classifier implements the at least one classification aimed at a particle size and/or density for the powdered intermediate product under a protective gas atmosphere.

The invention also relates to a starting material which is provided for manufacturing rare earth magnets and has been produced by a method according to any one of the specific embodiments described above. With the starting material according to the invention, a fraction of particles >8 μm amounts to ≤2 volume percent, in particular being in a range between 0.1 volume percent and 1 volume percent or a fraction of particles of <2 μm is at ≤2 volume percent, and in particular in a range between 0.05 volume percent and 2 volume percent.

In addition, the invention relates to a method for manufacturing rare earth magnets. This method comprises the following steps:

- producing a starting material by means of a method according to any one exemplary embodiment of the preceding description,
- introducing the starting material into molds and pressing the starting material into the molds, wherein blanks are formed from the starting material,
- sintering the blanks and exposing the sintered blanks to a magnetization pulse, so that, as a result, the sintered blanks, which have been exposed to a magnetization pulse, are embodied as rare earth magnets and may optionally be subjected to a mechanical processing.

It may also happen that, by means of the method described here for manufacturing rare earth magnets, a starting material according to the previous description is produced, and this starting material is introduced into the molds and pressed there.

The invention also relates to an installation for manufacturing a powdered starting material, which is provided for manufacturing rare earth magnets. Features which have already been described above for various embodiments of the method may also be provided in the installation described below and therefore will not be mentioned again redundantly. Features described subsequently, which pertain to various embodiments of the installation according to the invention, may optionally also be provided in the method already described above.

The installation for manufacturing a powdered starting material, which is provided for manufacturing rare earth magnets, comprises at least one pulverizing device, which is directed at creating a powdered intermediate product by pulverizing an alloy comprising at least one rare earth metal.

In addition, the installation comprises at least one separating device, which can separate one fraction from the powdered intermediate product by means of at least one classification and/or sorting operation directed at particle size and/or density, such that the fraction forms the starting material intended for fabrication of the rare earth magnets.

It is provided that the at least one separating device comprises at least one dynamic classifier, which can separate the fraction that forms the starting material intended for manufacturing rare earth magnets from the powdered intermediate product by means of a classification process aimed at particle size and/or density.

In preferred specific embodiments, it is possible to provide that the at least one separating device comprises at least one static classifier, to which the powdered intermediate product can be supplied. The at least one static classifier and the at least one dynamic classifier can be connected to one another at least in such a way that a fraction separated from the supplied intermediate product by means of the at least one static classifier can be supplied to the at least one dynamic classifier. The at least one dynamic classifier may then optionally separate from the supplied portion the fraction which forms the starting material provided for manufacturing rare earth magnets.

It may be possible for the at least one dynamic classifier to be designed for classifying and dispersing the powdered intermediate product supplied.

It may also be that the at least one pulverizing device comprises two successive pulverizing machines, each of which is designed for pulverizing, preferably mechanically, the alloy comprising at least one rare earth metal, and they cooperate with one another to create the powdered intermediate product from the alloy comprising the at least one rare earth metal.

Furthermore, embodiments in which the at least one dynamic classifier can carry out the classification directed at particle size and/or density under a protective gas atmosphere.

The starting material which can be produced in the context of the method described previously and/or by means of the installation described previously may comprise essentially particles of a target size range and may have hardly any contamination with particles smaller than the particles of the target size range. These are also referred to in the following discussion as superfine particles. In addition the starting material produced as part of the method described above and/or by means of the installation described above may essentially comprise hardly any contamination with particles larger than the particles of the target size range. These are subsequently also referred to as coarse particles.

In particular a starting material comprising essentially only particles with a size within the target size range in an essentially homogenous mixture can be produced by a method and/or in an installation according to the previous description. With regard to the starting material which can be produced by the method described above and/or by means of the installation described above, specific embodiments have proven successful in which the starting material comprises particles in the target size range between 1 μm and 10 μm, in particular in a target size range between 2 μm and 8 μm. In pulverizing an alloy comprising at least one rare earth metal, it is unavoidable in practice for a fraction of extremely fine particles that are smaller than the target size range to be formed. Furthermore, in most cases, there is a fraction of coarse particles that have not been adequately pulverized. A good compromise must always be made here. Further milling of the starting material would result in a reduction in the fraction of coarse particles, but at the same time, this would also cause an increase in the amount of extremely fine particles that are also unwanted. A large amount of extremely fine particles and/or coarse particles based on volume percent in the starting material is associated with unwanted properties of the respective rare earth magnets manufactured and/or fabricated from the starting material.

A starting material produced as part of the preceding method and/or by means of the installation described above especially preferably contains ≤2 volume percent of extremely fine particles, in particular ≤1 volume percent. In addition it is possible to provide that starting material produced as part of the preceding method and/or by means of the installation described above contains ≤2 volume percent of coarse particles, in particular ≤1 volume percent.

According to a preferred specific embodiment, the starting material produced as part of the method described above and/or by means of the installation described above contains essentially and/or primarily particles in the target size range between 2 μm and 8 μm, wherein a fraction of particles whose size is >8 μm is ≤2 volume percent, in particular in a range between 0.1 volume percent and 1 volume percent, in particular in a range between 0.1 volume percent and 1 volume percent and wherein a fraction of particles whose size is ≤2 μm accounts for ≤2 volume percent, in particular in a range between 0.05 volume percent and 2 volume percent.

The at least one dynamic classifier that was already mentioned above and is designed as a component of the method and/or installation according to the invention comprises at least one dynamic classifier, which may include a classifier rotor. A rotational speed of the classifying rotor may be controlled and/or regulated as a function of a particle size distribution desired for the starting material to be produced. To do so, a control and/or regulating unit, which is connected to the at least one dynamic classifier, may be provided. An algorithm stored in the control and/or regulating device can make it possible for the control and/or regulating unit to automatically regulate and/or control the rotational speed of the classifying rotor, which is embodied as a component of the at least one dynamic classifier, taking into account the respective particle size distribution desired for the starting material to be produced.

The at least one static classifier, which is mentioned above and is provided in various embodiments of a method and/or an installation according to the invention, may optionally be formed by at least one cyclone classifying device. By means of the at least one cyclone classifying device, it is possible to achieve pulverization of the superfine particle size, if necessary. A powdered mixture, which is separated by means of at least one static classifier and/or at least one cyclone classifier and is referred to below as a powdered intermediate product, usually still contains up to 10 volume percent of superfine particles and/or up to 10 volume percent of coarse particles after separation of the superfine particles. The superfine fractions, which are necessarily always present in such a powdered intermediate product, thus have a negative effect in many regards on the properties of the rare earth magnets produced from them.

To further improve the particle composition, the ground and powdered intermediate product which has optionally already been freed of portions of superfine particles by means of the at least one static classifier, if necessary, is subjected to at least one additional classification operation, implemented by at least one dynamic classifier. To be able to carry out this classification operation efficiently, embodiments that have proven successful are those in which the powdered intermediate product is first dispersed, and then a classification is carried out according to the particle size and/or density of the dispersed powdered intermediate product. This dispersion and classification according to particle size and/or density can be carried out with precision in exactly one dynamic classifier. By means of the at least one dynamic classifier and/or the exactly one dynamic classifier, then superfine particles and/or coarse particles can be removed from the powdered intermediate product.

In other words, the method may comprise the following steps individually or in combination:

- dispersion of the intermediate product and/or
- renewed separation of superfine particles and/or coarse particles.

It is thus preferably possible to provide that the dispersion of the intermediate product and the renewed separation of superfine particles and/or coarse particles are carried out within a single device, in particular within a single dynamic classifier. Based on the high chemical reactivity of superfine particles that are optionally present in high concentration in the powdered intermediate product, the only dynamic classifier may implement a dispersion and/or classification, optionally under a protective gas atmosphere. Helium, argon, nitrogen and the like, for example, may be used as the protective gas.

The at least one rare earth metal, which is embodied as a component of the alloy may be formed by iron and/or boron, for example. The alloy comprising at least one rare earth metal may be an NdFeB alloy, for example. A starting material consisting essentially of only particles in the target size range between 1 μm and 10 μm, preferably between 2 μm and 8 μm can be produced from this alloy containing at least one rare earth metal by means of the method steps described above and/or by means of the installation described above. The starting mixture preferably contains 95 volume percent, in particular 98 volume percent of particles in the target size range, said target size range being set at 2 μm to 8 μm.

The installation described above may include a device for coarse pulverizing of an alloy comprising at least one rare earth metal. A coarse powder fraction optionally formed from the at least one alloy comprising a rare earth metal with the aid of the device for coarse pulverizing may optionally be ground in a device for fine pulverization, designed as a component of the installation, to yield a fine powder fraction, wherein the fine powder fraction forms the powdered intermediate product. The device for fine pulverization may preferably be embodied as a fluidized bed jet mill.

BRIEF DESCRIPTION OF THE DRAWINGS

Embodiments below should illustrate the invention and its advantages in greater detail on the basis of the accompanying figures. The size ratios of the individual elements to one another in the figures do not always correspond to the actual size ratios because some shapes have been simplified and other shapes have been illustrated as enlarged diagrams in relation to the other elements for the sake of a better illustration. The features described below are not closely associated with the respective embodiment but instead may be used in the general context.

DETAILED DESCRIPTION

Figure 1:
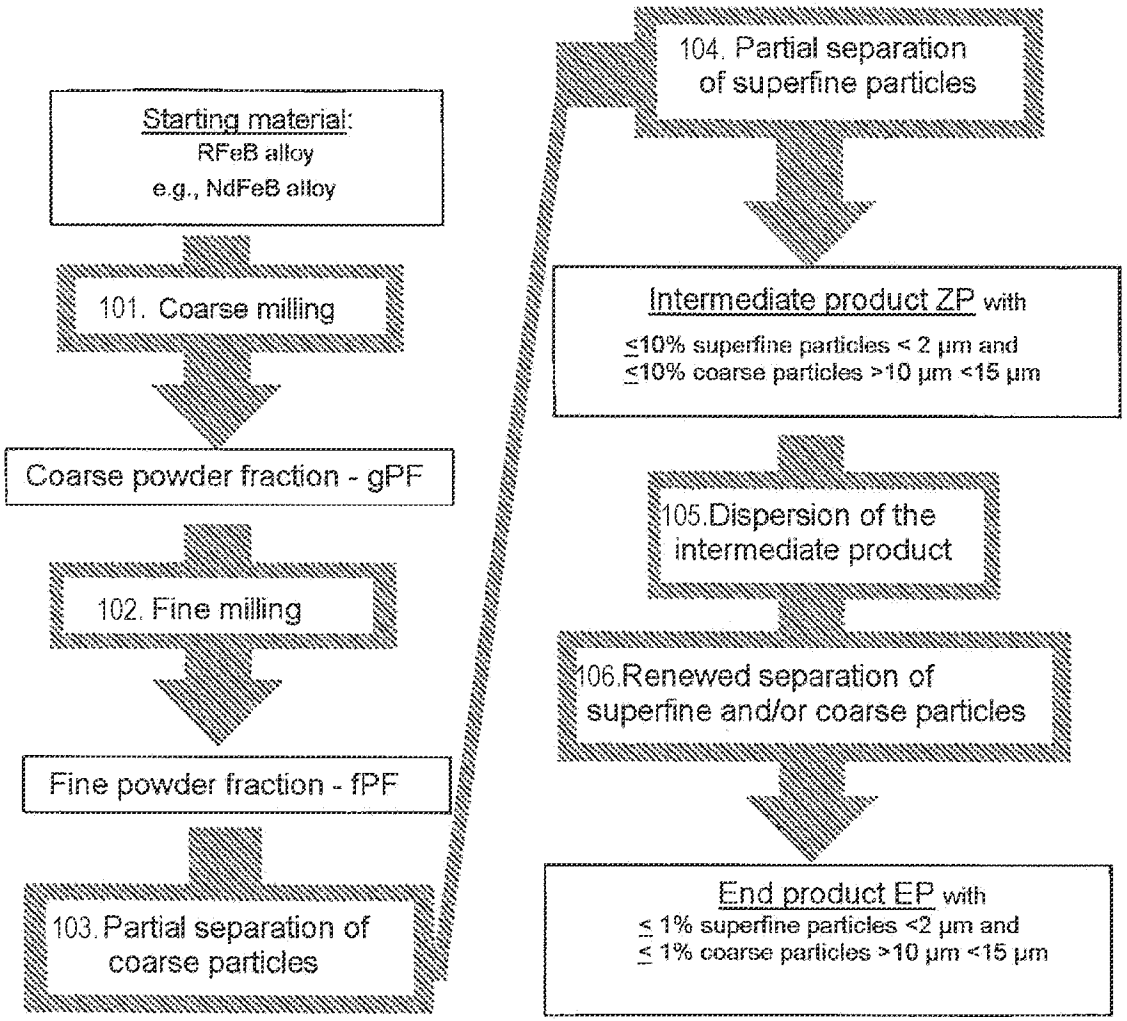
FIG. 1 shows schematically the method steps for manufacturing a starting material for manufacturing rare earth magnets such as those that may be provided individually or in the combination shown.

Identical reference numerals are used for the same elements of the invention or those having the same effect. Furthermore, for the sake of an, overview only reference numerals that are needed for the description of the respective figure are shown in the individual figures. The embodiments illustrated here represent only examples of how the invention may be embodied and do not constitute a conclusive delineation.

FIG. 1 shows schematically process steps for producing a starting material AM for manufacturing rare earth magnets. A suitable RFeB alloy containing the ingredients R=rare earth metal, Fe=iron and B=boron in the desired quantity ratios is used as the basis for this starting material. For example, an NdFeB alloy is used to manufacture a so-called neodymium magnet. Under some circumstances, an alloy must first be produced from the elements in the desired quantity ratios. This alloy is then subjected to a coarse milling in a first working step, for example, in a mechanical milling system or by embrittlement with hydrogen. Particles with a size of up to a few mm are produced in this way. Then the coarse powder fraction gPF obtained as part of the coarse milling process is subjected to a fine milling, in which particles with an average particle size between d50=2 μm and 5 μm are produced or should be produced. In other words, the d50 value of the fine powder fraction fPF is between 2 μm and 5 μm, with a broad particle distribution accordingly in terms of finer as well as coarser particles, with the corresponding amounts of superfine particles (d10=approx. 1-2 μm) and coarse fractions (d90=approx. 8-15 μm). The coarse particles gP are chemically stable, in contrast with the particles fP of the superfine fraction described below and they can also be oriented well in magnetic fields, but they have negative effects on the opposing field stability of the magnet because these coarse particles gP already undergo remagnetization in low magnetic opposing fields and thus exacerbate the opposing field stability (and/or the coercitive field strength) of the entire magnet. For this reason, it is advantageous to further reduce the amount of coarse particles gP in the staring mixture for the production of sintered permanent magnets.

The particles fP of the superfine fraction are highly reactive chemically because of their fineness, and they react with the oxygen or even with the nitrogen from the environment at even the lowest oxygen concentrations. These superfine particles fP can cause spontaneous powder fires in further processing of the powders. Another disadvantage of the superfine particles fP is that it is very difficult to orient these fine particles in the magnetic fields and press devices that are usually available (order of magnitude approx. 10-20 kOe) and therefore have a negative effect on the remanence of the magnets produced from these particles. For this reason, in a fourth or additional method step, superfine fractions, in particular particles with a diameter of 1-2 μm are removed from the fine powder fraction fPF. To do so, the mixture is passed through a cyclone, for example, following the coarse milling and fine milling according to points 101 and 102, so that the superfine fraction is entrained by means of a suitable gas stream and thereby separated from the mixture. This forms the intermediate product ZP, but this still contains a not insignificant amount of up to 10% superfine particles smaller than approx. 1 μm to 2 μm.

To remove these remaining fractions of superfine particles fP μm to 2 μm and/or coarse particles gP between 10 μm and 15 μm as thoroughly as possible, the intermediate product ZP is subjected to at least one additional classification operation to remove unwanted superfine particles fP or coarse particles gP or superfine particles fP and coarse particles gP and thereby further improve the homogeneity of the particles in the target size ZG, in particular to obtain a powder mixture, which essentially comprises only particles with particle sizes in the target range between approx. 2 μm and 8 μm as the starting material AM, because these particles are the best powder fraction from a magnetic standpoint. All the additional steps that follow with regard to the step according to point 104 are carried out with the help of a dynamic classifier 10 (cf. FIGS. 2 and 3) and/or a high-performance classification device.

The particles with the target size ZG between 2 μm and 8 μm are sufficiently stable chemically so that they do not cause any additional oxidation in the normal production process. Furthermore they can be oriented well with the usual magnetic fields. They thus make a substantial contribution toward achieving a high remanence of the magnets thereby produced and are therefore desirable, necessary and beneficial. The more powder particles of this target size ZG are present, the better are the magnetic values (remanence Br and opposing field stability HcJ) of the magnets produced from these particles.

In another, i.e., the present fifth method step, the powdered intermediate product ZP is dispersed to establish the most homogenous possible distribution of the different particles of the intermediate product ZP. In doing so, in particular molecular and magnetic attractive forces between the particles are overcome and a renewed classification and separation of particles of the superfine fraction or particles of the coarse fraction is possible following the dispersion. For this process step a dynamic classifier 10 (cf. FIGS. 2 and 3) or high-performance classifying device is also used.

The dispersed, powdered, intermediate product ZP is classified again and particles of the superfine fraction and/or particles of the coarse fraction are removed. This establishes an optimum separation of superfine fraction and coarse fraction for the desired particle target size ZG. The superfine fraction of particles the size of which is μm is reduced to a fraction of less than 1%. Alternatively or additionally, the coarse fraction of particles, the size of which is greater than 10 μm, can also be reduced to an amount of less than 1%.

This at least one additional classification process is preferably carried out under a protective gas atmosphere, for example, under helium, argon or nitrogen, but this should not be a final list of options. The protective gas atmosphere prevents spontaneous powder fires due to the superfine particles fP in particular.

Figure 3:
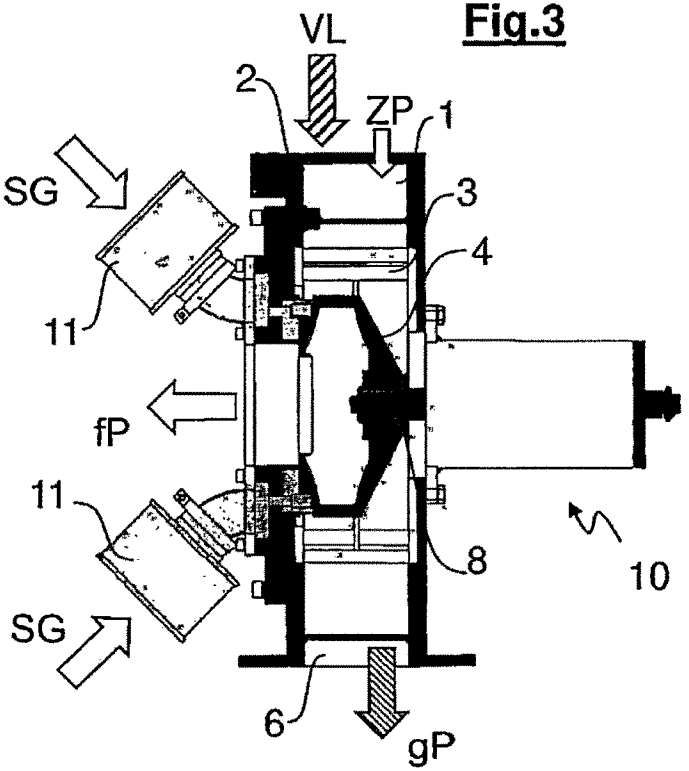
FIG. 3 shows a lateral cross section through the dynamic classifier according to FIG. 2.
Figure 2:
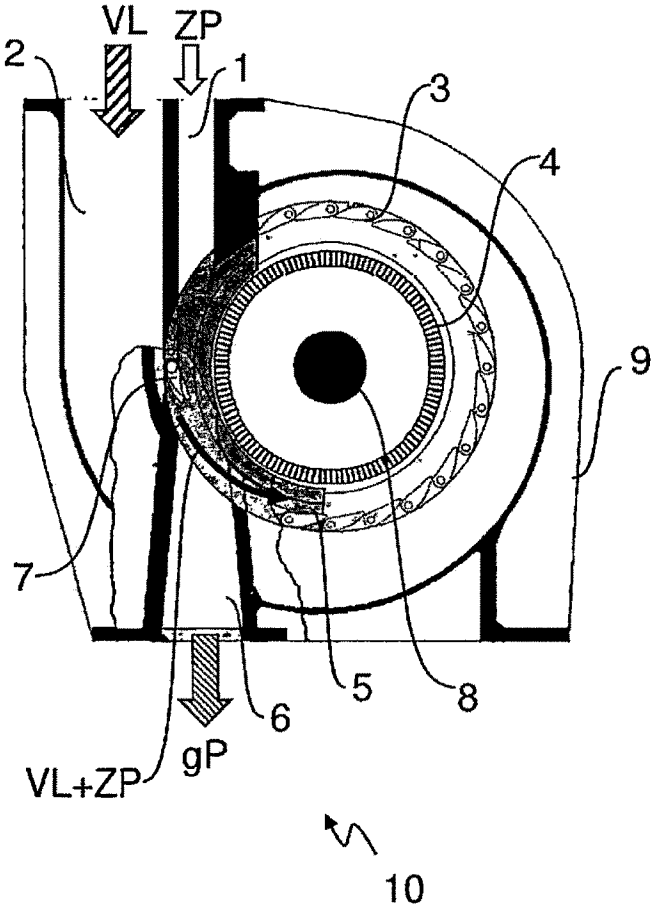
FIG. 2 shows a cross section through a dynamic classifier such as that which may be provided in various embodiments of the method according to the invention as well as in various embodiments of the installation according to the invention.

The fifth and sixth method steps and/or the last two method steps, i.e., dispersion and separation of superfine particles fP and/or separation of coarse particles gP, may preferably take place in particular in a dynamic classifier 10 according to FIGS. 2 and 3.

With regard to the embodiment of a dynamic classifier 1 according to FIGS. 2 and 3, the powdered intermediate product ZP is supplied to the classifying device and/or to the dynamic classifier 10 from above through the product feed 1. The necessary process air VL, which entrains the powdered intermediate product ZP, is supplied through the product feed 1 via the air inlet 2 of the classifying device, and passes through a plurality of adjustable guide vane gaps in the static guide vane cage 3, so that the intermediate product ZP is dispersed. In the present case, a protective gas is used as the process air VL.

The intermediate product ZP, which is dispersed in this way, is passed over a classifier wheel 4, the rotational speed of which is continuously adjustable, so that the particle sizes are separated either into the target material and coarse material or into target material and superfine material.

The optimized classifier wheel design ensures that a very great fineness can also be achieved with high throughputs by using only one classifier wheel 4. The superfine particles fP leave the classifying device 10 at the center of the classifier wheel 4 and/or the dynamic classifier 10, which is installed with a horizontal shaft 8. The coarse particles gP are rejected by the classifier wheel 4 and are discharged through the coarse material outlet 6 on the bottom of the machine housing 9 at the rear side by the machine housing 9, which is designed in a helical shape and provided with a partition 5. The discharge of the coarse particles gP in difficult separation jobs can be regulated by the position of the coarse material valve 7, so that the cleanliness of the coarse particles gP is influenced in this way. The particles of the target size ZP leave the dynamic classifier 10 together with the coarse material through the coarse material outlet 6. The superfine particles fP are separated from the particles of the target size ZP and therefore do not form a component of the fraction leaving the dynamic classifier 10 through the coarse material outlet 6.

The desired target particle size ZG is regulated here in particular by regulating the gas stream of process air VL and/or the rotational speed of the classifier wheel 4. A higher gas stream and/or a lower rotational speed result in a coarser product while a lower gas stream and/or a higher rotational speed lead to a finer product.

In addition, FIG. 3 shows the at least two cracked gas feeds (11), which are necessary to flush the gap between the fine material outlet and the classifier wheel (4) with so-called cracked gas. However, embodiments with just one cracked gas feed (11) are also possible. This flushing prevents particles in the classifier wheel (4) and/or in the gap between the outlet for fine material and the classifier wheel (4) from being deposited and clogging the gap. The flushing takes place by means of a fluid suitable for this purpose, namely by means of protective gas in a preferred embodiment.

Figure 4:
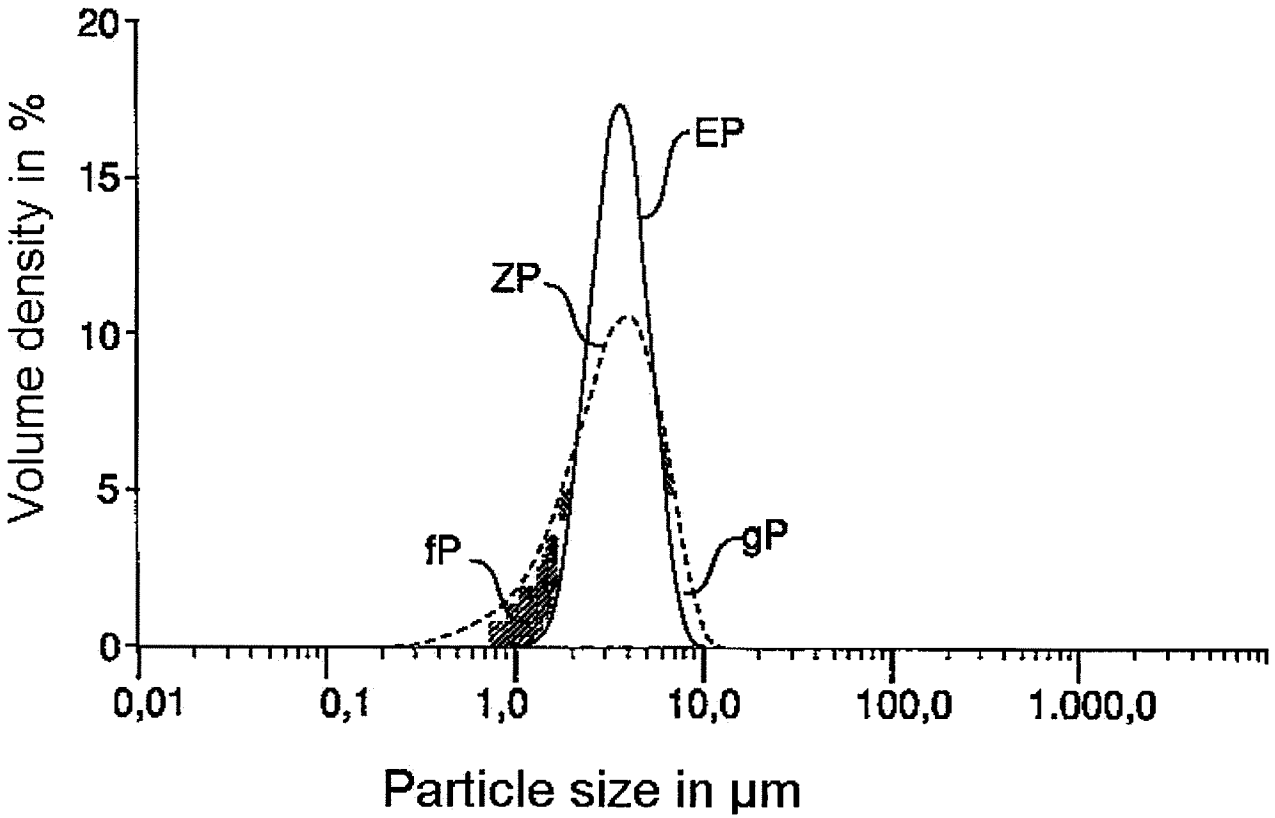
FIG. 4 shows a conceivable particle size distribution of a powdered intermediate product for various embodiments of the method and/or installation according to the invention as compared with a conceivable particle size distribution of a starting material provided for manufacturing rare earth magnets.

FIG. 4 shows the particle size distribution in the intermediate product ZP and in the starting material AM. The diagram shows in particular the particle size in μm, plotted as a function of the amount of the volume density of the respective mixture in percentage. This shows clearly that a more homogeneous particle mixture in the starting material AM, in which the amount of superfine particles fP constitutes ≤1% of the volume density, and in which the fraction of coarse particles gP also constitutes ≤1% of the volume density, can be achieved by the additional method step of dispersing the intermediate product ZP and classification, with subsequent separation of superfine particles fP ≤1 μm and/or coarse particles gP ≥10 μm through a dynamic classifier 10. In particular, the fractions of superfine particles fP and coarse particles gP illustrated with hatching are removed from the powdered intermediate product ZP.

The starting material AM prepared in this way is suitable in particular for production of sintered rare earth magnets because of the particle size between 1 μm and 10 μm, preferably between 2 μm and 8 μm, because with these particle sizes of the starting material AM especially good magnet values can be achieved. In particular, high (improved) remanence values BR and a good (improved) opposing field stability HcJ as well as a definite improvement in the square-wave property of the demagnetization curve are achieved with the starting material AM for the production of permanent magnets.

Figure 6:
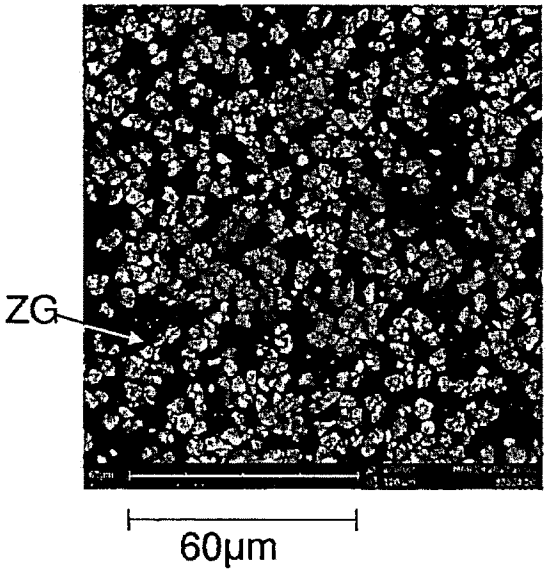
FIG. 6 shows a scanning electron micrograph of a starting material, such as that which can be produced by means of the method according to the invention and/or the installation according to the invention in various embodiments.
Figure 5:
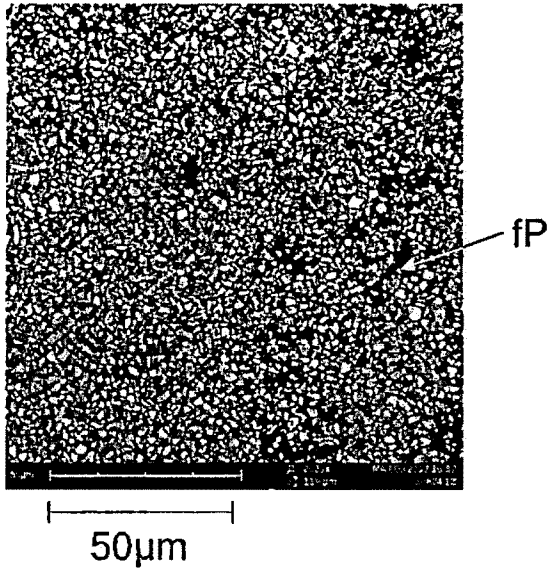
FIG. 5 shows a scanning electron micrograph, such as that which can be produced for the powdered intermediate product.

FIG. 5 shows a scanning electron micrograph of the powdered intermediate product ZP, and FIG. 6 shows a scanning electron micrograph of the starting material AM, as produced in various embodiments of the method according to the invention, and as can be used to produce rare earth magnets. Whereas the intermediate product ZP is a highly heterogeneous mixture of different particle sizes, and contains in particular a large amount of superfine particles fP, FIG. 6 shows clearly that the twice-classified starting material AM contains mainly only particles of a target size ZG between 1 μm and 10 μm, preferably between 2 μm and 8 μm.

The embodiments, examples and variants of the preceding paragraphs, claims or the following description and figures including their various views or respective individual features may be used independently of one another or in any combination. Features, which are described in conjunction with one embodiment, may be used for all embodiments if the features are not inconsistent. The invention has been described with reference to preferred specific embodiments. It is conceivable for those skilled in the art that modifications or amendments to the invention can be made without going beyond the scope of protection of the following claims. It is possible to use some of the components or features of one of the examples in combination with features or components of another example.

What is claimed is:

1. A method for producing a powdered starting material provided for production of rare earth magnets, comprising the following steps:

pulverizing an alloy that includes at least one rare earth metal to form a powdered intermediate product, said powdered intermediate product includes said at least one rare earth metal;

carrying out at least one classification directed at particle size and/or particle density using at least one dynamic classifier to separate a fraction from the powdered intermediate product;

dispersing the fraction using the at least one dynamic classifier for establishing a homogenous distribution of particles in the fraction; and carrying out a renewed classification using the at least one dynamic classifier to separate a further fraction from the dispersed fraction;

wherein the further fraction forms the starting material for manufacturing rare earth magnets, wherein the at least one dynamic classifier comprises a classifying rotor, wherein said at least one classification comprises at least two classifications that follow one another in time, each directed at particle size and/or particle density, wherein as part of a first classification of the at least one dynamic classifier, directed at particle size and/or particle density, coarse material is separated from the powdered intermediate product, and wherein as part of a second classification of the at least one dynamic classifier, directed at particle size and/or density, fine material is separated from the powdered intermediate product.

2. A method for producing a powdered starting material provided for production of rare earth magnets, comprising the following steps:

pulverizing an alloy that includes at least one rare earth metal to form a powdered intermediate product, said powdered intermediate product includes said at least one rare earth metal;

carrying out a classification using at least one static classifier to separate a portion of the powdered intermediate product;

carrying out at least one classification directed at particle size and/or particle density using at least one dynamic classifier to separate a fraction from the portion of the powdered intermediate product;

dispersing the fraction using the at least one dynamic classifier to establishing a homogenous distribution of particles in the fraction; and carrying out a renewed classification using the at least one dynamic classifier to separate a further fraction from the dispersed fraction;

wherein the further fraction forms the starting material for manufacturing rare earth magnets, wherein the at least one dynamic classifier comprises a classifying rotor, and the at least one static classifier comprises a cyclone classifier, wherein said at least one classification comprises at least two classifications that follow one another in time, each directed at particle size and/or particle density, wherein as part of a first classification of the at least one dynamic classifier, directed at particle size and/or particle density, coarse material is separated from the portion of the powdered intermediate product, and wherein as part of a second classification of the at least one dynamic classifier, directed at particle size and/or density, fine material is separated from the portion of the powdered intermediate product.

3. The method according to claim 2, in which the first classification and the second classification are performed by exactly one dynamic classifier.

4. The method according to claim 2, wherein the alloy including at least one rare earth metal is pulverized, preferably mechanically, into separate steps, wherein the powdered intermediate product is formed from the pulverized material in separate steps.

5. The method according to claim 2, wherein the at least one dynamic classifier performs the at least one classification directed at particle size and/or particle density for the portion of the powdered intermediate product under a protective gas atmosphere.

6. A method for manufacturing rare earth magnets including the following steps:

producing a starting material by the method according to claim 2, introducing the starting material into molds and pressing the starting material into the molds, forming blanks from the starting material, sintering the blanks and exposing the sintered blanks to a magnetization pulse so that as a result the sintered blanks that have been exposed to the magnetization pulse are formed as rare earth magnets.

7. The method for manufacturing rare earth magnets according to claim 6, wherein the starting material includes a fraction of particles >8 μm in an amount volume percent and/or a fraction of particles <2 μm in an amount volume percent.

8. The method according to claim 7, wherein the fraction of particles >8 μm is in a range between 0.1 volume percent and 1 volume percent.

9. The method according to claim 7, wherein the fraction of particles <2 μm is in a range between 0.05 volume percent and 2 volume percent.

10. The method according to claim 2, further comprising:

entraining the portion of the powdered intermediate product with a gas and supplying the entrained portion to the at least one dynamic classifier, passing the entrained portion through a static guide vane cage of the at least one dynamic classifier to disperse the entrained portion, and passing the dispersed portion over the classifying rotor to separate the fraction from the portion of the powdered intermediate product.

11. The method according to claim 2, wherein the at least one dynamic classifier provides for the starting material to include a fraction of particles >μm in an amount ≤2 volume percent and/or a fraction of particles <μm in an amount ≤2 volume percent.

* * * * *